US007815286B2

(12) United States Patent
Onozawa

(10) Patent No.: US 7,815,286 B2
(45) **Date of Patent: *Oct. 19, 2010**

(54) MIST EJECTION HEAD AND IMAGE FORMING APPARATUS

(75) Inventor: Sho Onozawa, Kanagawa (JP)

(73) Assignee: FujiFilm Corporation, Tokyo (JP)

( * ) Notice: Subject to any disclaimer, the term of this patent is extended or adjusted under 35 U.S.C. 154(b) by 1087 days.

This patent is subject to a terminal disclaimer.

(21) Appl. No.: 11/504,687

(22) Filed: Aug. 16, 2006

(65) Prior Publication Data

US 2007/0040043 A1 Feb. 22, 2007

(30) Foreign Application Priority Data

Aug. 17, 2005 (JP) ..... 2005-236555

(51) Int. Cl.
*B41J 2/135* (2006.01)

(52) U.S. Cl. ..... 347/44; 347/46; 347/68; 347/70

(58) Field of Classification Search ..... 347/44, 347/46, 47, 68, 70, 75
See application file for complete search history.

(56) References Cited

U.S. PATENT DOCUMENTS 4,308,547 A * 12/1981 Lovelady et al. ..... 347/46
4,959,674 A * 9/1990 Khri-Yakub et al. ..... 347/46
5,121,141 A * 6/1992 Hadimoglu et al. ..... 347/46
5,156,144 A * 10/1992 Iwasaki et al. ..... 601/4
6,154,235 A * 11/2000 Fukumoto et al. ..... 347/46
6,217,151 B1 * 4/2001 Young ..... 347/46
6,283,579 B1 * 9/2001 Haga et al. ..... 347/46
6,336,707 B1 * 1/2002 Asai et al. ..... 347/46
6,497,510 B1 * 12/2002 Delametter et al. ..... 347/74
6,692,106 B2 * 2/2004 Aizawa et al. ..... 347/46
7,426,866 B2 * 9/2008 Van Tuyl et al. ..... 73/597
2002/0063751 A1 5/2002 Aizawa et al.

FOREIGN PATENT DOCUMENTS

JP 62-85948 A 4/1987
JP 62-111757 A 5/1987
JP 10-278253 A 10/1998
JP 2002-166541 A 6/2002

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The mist ejection head comprises: a nozzle ejecting a liquid in a form of a mist; a liquid chamber connected to the nozzle; an ultrasonic wave generating element which is disposed on a side wall of the liquid chamber and which generates an ultrasonic wave in such a manner that the ultrasonic wave is applied to the liquid inside the liquid chamber; and a reflector having a reflecting surface which reflects the ultrasonic wave generated by the ultrasonic wave generating element in such a manner that the ultrasonic wave is directed toward a center of the liquid chamber and concentrated at a focal point situated in a vicinity of the nozzle inside the liquid chamber.

3 Claims, 12 Drawing Sheets

MIST EJECTION HEAD AND IMAGE FORMING APPARATUS

BACKGROUND OF THE INVENTION

1. Field of the Invention

The present invention relates to a mist ejection head and an image forming apparatus, and more particularly, to a mist ejection head and an image forming apparatus which each eject mist.

2. Description of the Related Art

For example, each of Japanese Patent Application Publication No. 62-85948, Japanese Patent Application Publication No. 62-111757, Japanese Patent Application Publication No. 10-278253, and Japanese Patent Application Publication No. 2002-166541 discloses a mist ejection head which ejects a mist, in other words, a group (cluster) of minute liquid droplets.

Stated in simple terms, the ejection of mist is performed by creating a mist of liquid by reducing the surface tension of the liquid by means of an ultrasonic wave. More specifically, in general, cavitation misting caused by cavitation (hollowing), and capillary misting caused by a capillary wave (capillary surface wave), are used. If the latter type of method is used, then it is possible to generate a mist of uniform particle size, and the energy efficiency is good. A capillary wave is generated by applying a planar wave in the direction of the free liquid surface. If the planar wave has a frequency and amplitude at or above a certain level, then the capillary wave starts to oscillate. As a result, mist is produced from the peaks of the capillary wave thus developed.

Furthermore, each of Japanese Patent Application Publication No. 10-278253 and Japanese Patent Application Publication No. 2002-166541 discloses an apparatus for creating mist. As shown in FIG. 11, it is known that energy efficiency is improved by means of a method in which an ultrasonic wave which is generated by an ultrasonic wave generating element 958 and introduced into the liquid in the liquid chamber 952 is reflected by the paraboloid (parabolic surface) 980*p* of a reflector 980, and caused to concentrate at the focal point F located in the vicinity of the nozzle 51.

However, in the mist ejection head 950 shown in FIG. 11, the ultrasonic wave (direct advance wave) which has not yet been reflected by the paraboloid 980*p* has an effect on the ultrasonic wave (reflected wave) which has been reflected by the paraboloid 980*p* of the reflector 980, and hence there is a possibility that the energy efficiency declines. Furthermore, as the size of the reflector 980 becomes smaller with the increase in density, it becomes difficult to ignore the effects of the direct advance wave on the reflected wave, and hence the ultrasonic wave applied to the meniscus (liquid surface) of the nozzle 51 loses coherence, the particle size varies, and the ejection efficiency declines.

If described in detail with respect to FIG. 11, the ultrasonic wave introduced into the liquid in the liquid chamber 952 from the ultrasonic wave generating element 958 proceeds inside the liquid chamber 952 as a planar wave, and when it is reflected by the paraboloid 980*p* of the reflector 980, then the reflected ultrasonic wave (reflected wave) is concentrated at a focal point F situated in the vicinity of the nozzle 51. On the other hand, the ultrasonic wave (direct wave) which has not been reflected by the paraboloid 980*p* of the reflector 980 travels forward and arrives at the meniscus of the nozzle 51. A gap g (referred to as the spatial gap) occurs between the wave fronts of the reflected wave and the direct wave which are in the same phase, and this spatial gap g becomes larger as the ultrasonic wave progresses through the liquid chamber 952.

At any desired point Q on the paraboloid 980*p*, the distance QF from the focal point F is equal to the distance QD from the reference line D. Depending on this characteristic of the parabola, when the reflected wave reflected by the reflecting surface 980*p* reaches the focal point F, the distance between the wave fronts of the reflected wave and the direct wave which are in the same phase, is equal to the distance between the focal point F and the reference line D. Accordingly, unless a pinpoint design is adopted in which the interval between the focal point F and the reference line D is an integral multiple of the wavelength of the ultrasonic wave, then the coherence can be impaired and the energy efficiency can decline.

SUMMARY OF THE INVENTION

The present invention is contrived in view of these circumstances, an object thereof being to provide a mist ejection head and an image forming apparatus in order to reduce the effects of the direct wave and to improve the energy efficiency.

In order to attain the aforementioned object, the present invention is directed to a mist ejection head comprising: a nozzle ejecting a liquid in a form of a mist; a liquid chamber connected to the nozzle; an ultrasonic wave generating element which is disposed on a side wall of the liquid chamber and which generates an ultrasonic wave in such a manner that the ultrasonic wave is applied to the liquid inside the liquid chamber; and a reflector having a reflecting surface which reflects the ultrasonic wave generated by the ultrasonic wave generating element in such a manner that the ultrasonic wave is directed toward a center of the liquid chamber and concentrated at a focal point situated in a vicinity of the nozzle inside the liquid chamber.

According to this aspect of the present invention, an ultrasonic wave is applied to the liquid in the liquid chamber by an ultrasonic wave generating element disposed on the side wall of the liquid chamber, and the ultrasonic wave is concentrated at a focal point in the vicinity of the nozzle by means of the reflecting surface of the reflector. Accordingly, the ultrasonic wave arriving at the focal point is almost completely constituted by a reflected wave, the effects of the direct wave on the reflected wave concentrated at the focal point can be reduced, and the energy efficiency can be improved.

Preferably, a cross-sectional shape of the reflecting surface of the reflector includes two parabolas whose confocal point is located at the same position as the focal point.

According to this aspect of the present invention, the cross-sectional shape of the reflecting surface of the reflector contains two parabolas having a confocal point, and the reflected wave is efficiently concentrated at the confocal point.

Preferably, the liquid chamber has a cylindrical shape having an axis passing through the focal point, and the reflector has a protrusion shape having the reflecting surface formed by rotating, around the axis of the liquid chamber, a parabola having a central axis which is perpendicular to the axis of the liquid chamber.

According to this aspect of the present invention, the liquid chamber has a cylindrical shape, and the reflector has a protrusion shape having a reflecting surface formed by rotating, around an axis of the liquid chamber, a parabola having a central axis which is perpendicular to the axis of the liquid chamber. Accordingly, the direct wave can be reduced reliably, and a mist ejection head having extremely high efficiency in concentrating the reflected wave can be manufactured readily.

In order to attain the aforementioned object, the present invention is also directed to an image forming apparatus comprising the mist ejection head as defined in claim 1, wherein the liquid is ejected from the nozzle in the form of the mist in such a manner that an image is formed by the liquid on a recording medium.

According to this aspect of the present invention, a high-quality image can be formed with good energy efficiency.

According to the present invention, the effects of the direct wave can be reduced and the energy efficiency can be improved.

BRIEF DESCRIPTION OF THE DRAWINGS

The nature of this invention, as well as other objects and benefits thereof, are explained in the following with reference to the accompanying drawings, wherein.

DETAILED DESCRIPTION OF THE PREFERRED EMBODIMENTS

Basic Composition of the Mist Ejection Head

Figure 1:
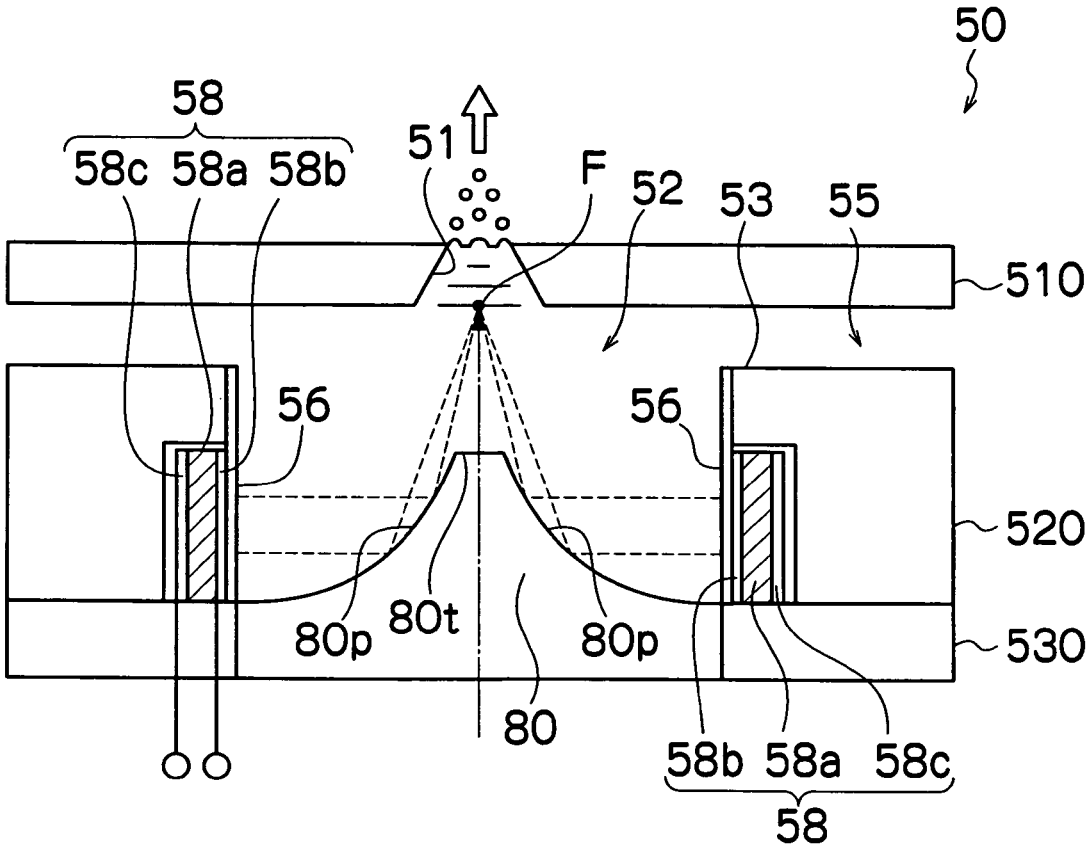
FIG. 1 is a cross-sectional diagram showing the basic composition of a mist ejection head relating to one embodiment of the present invention.

FIG. 1 is a cross-sectional diagram showing the basic composition of a mist ejection head relating to one embodiment of the present invention.

As shown in FIG. 1, the mist ejection head 50 comprises: a nozzle 51 forming an opening section from which ink is ejected in the form of a mist; a liquid chamber 52 connected to the nozzle 51; an ink supply port 53 forming an opening section through which ink is supplied to the liquid chamber 52; a common liquid chamber 55 through which ink flows in order to be supplied to the liquid chamber 52 via the ink supply port 53; an ultrasonic wave generating element 58 which is disposed on the side wall 56 of the liquid chamber 52 and generates an ultrasonic wave and applies the ultrasonic wave to the ink inside the liquid chamber 52; and a reflector 80 which reflects an ultrasonic wave from the ultrasonic wave generating element 58 and concentrates the wave at a focal point F situated in the vicinity of the nozzle 51 inside the liquid chamber 52.

The ultrasonic wave generating element 58 includes a piezoelectric body 58*a*, and electrodes 58*b* and 58*c* to which drive signals are applied.

Furthermore, the mist ejection head 50 has a laminated structure created by stacking a reflector plate 530 formed with a reflector 80, a liquid chamber plate 520 formed with a liquid chamber 52 and an ultrasonic wave generating element 58, and a nozzle plate 510 formed with a nozzle 51.

The ultrasonic wave generated by the ultrasonic wave generating element 58 disposed on the side wall 56 of the liquid chamber 52 is introduced into the liquid inside the liquid chamber 52, via the side wall 56 of the liquid chamber 52, by using the side wall 56 as a diaphragm, and the ultrasonic wave travels in a parallel fashion toward the center of the liquid chamber 52. In other words, the wave travels in a planar form in a direction perpendicular to the axis of this liquid chamber 52, in such a manner that it travels toward the axis of the liquid chamber 52 which passes through the focal point F.

The ultrasonic wave which progresses toward the axis of the liquid chamber 52 in this way is reflected by a paraboloid (parabolic surface) 80*p* of the reflector 80. The focal point F with respect to the paraboloid 80*p* is situated in the vicinity of the nozzle 51 in the liquid chamber 52, and therefore, the ultrasonic wave (reflected wave) which is reflected by the radiating surface 80*a* of the reflector 80 travels toward the focal point F inside the liquid chamber 52, and converges at the focal point F.

The direction (shown by the arrow in FIG. 1) in which the liquid is ejected in the form of a mist from the nozzle 51 corresponds to the axis direction of the liquid chamber 52 which passes approximately through the focal point F.

The cross-sectional shape of the paraboloid 80*p* forming the reflecting surface of the reflector 80, and more specifically, the cross-sectional shape of the paraboloid 80*p* when sectioned in a plane parallel to the direction of ejection passing through the focal point F, comprises two parabolas having one focal point F as a confocal point.

By means of a structure of this kind, it is possible to make the reflected wave concentrate efficiently at the focal point F. More specifically, the ultrasonic wave which is generated by the ultrasonic wave generating element 58 and introduced into the liquid inside the liquid chamber 52 via the side wall 56 of the liquid chamber 52, and which has traveled in a planar state toward the axis of the liquid chamber 52, is reflected at an obtuse angle by the paraboloid 80*p* of the reflector 80, and hence the wave is reflected with little loss of energy and is also concentrated with good efficiency at the focal point F.

Furthermore, the apex 80*t* of the reflector 80 (in other words, the uppermost end section of the paraboloid 80*p*) is set at the same height as (or a greater height than) the uppermost end of the ultrasonic wave generating element 58, which is disposed on the side wall 56 of the liquid chamber 52.

By means of a structure of this kind, the ultrasonic wave which has been generated by the ultrasonic wave generating element 58 and introduced into the liquid in the liquid chamber 52 via the side wall 56 of the liquid chamber 52, and which has traveled in a planar state toward the axis of the liquid chamber 52 is not a direct wave, but rather, the ultrasonic wave arriving at the focal point F is a reflected wave, and therefore, adverse effects, such as attenuation, interference, and the like, are reduced and energy efficiency is improved.

Figure 2:
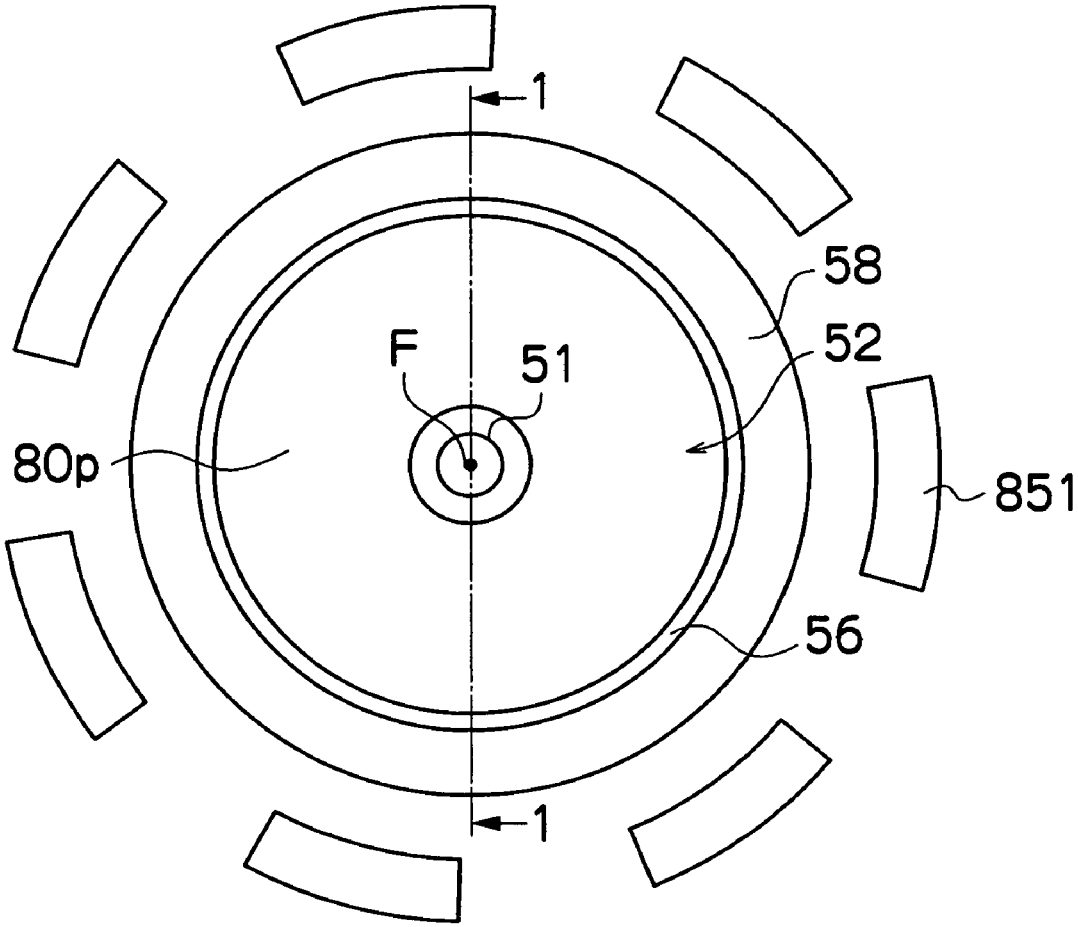
FIG. 2 is a plan view perspective diagram showing the principal part of the mist ejection head in FIG. 1.
Figure 3:
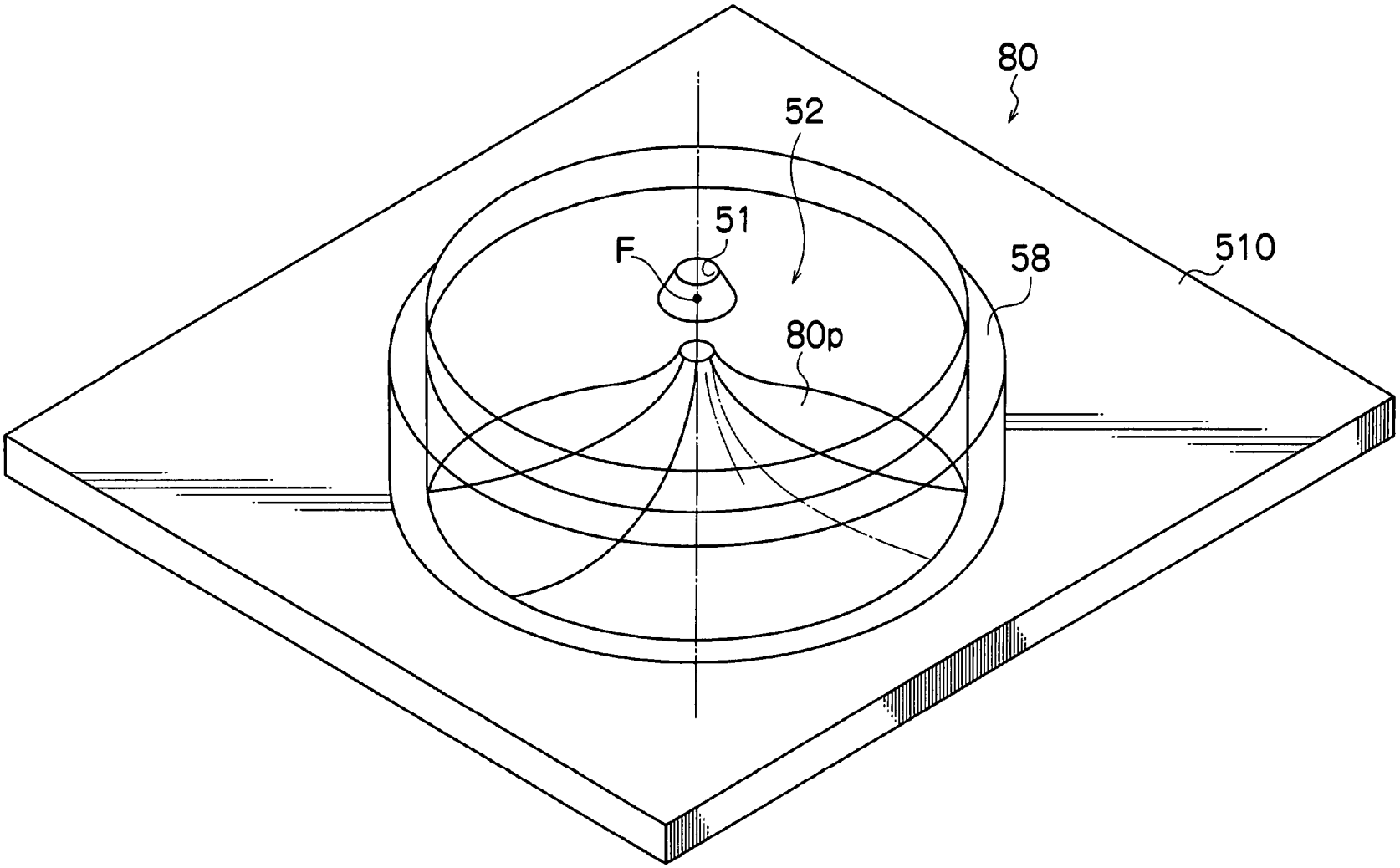
FIG. 3 is an oblique perspective diagram showing the principal part of the mist ejection head in FIG. 2.

In order to aid understanding of a desirable structure, in other words, a structure which maximizes the energy efficiency, FIG. 2 shows a plan view perspective diagram of a mist ejection head 50 having the basic composition in FIG. 1, and FIG. 3 shows an oblique perspective diagram which shows a schematic view of the principal parts of the head. Furthermore, FIG. 1 shows a cross-section along line 1-1 in FIG. 2.

In FIGS. 2 and 3, the liquid chamber 52 has a cylindrical shape having an axis passing through the focal point F. Furthermore, the reflector 80 is a protrusion shape. The paraboloid 80*p* of the protrusion-shaped reflector 80 of this kind is formed by rotating, around the axis of the liquid chamber 52, a parabola having a central axis which perpendicularly intersects, at the focal point F, with the axis of the liquid chamber 52 passing through the focal point F.

The nozzle plate 510 in which the nozzle 51 is formed and the liquid chamber plate 520 in which the liquid chamber 52 is formed are bonded together via supporting columns 851 located outside the liquid chamber 52, in the horizontal cross-section shown in FIG. 2, and they are not bonded in the inner side of the liquid chamber 52. Due to the structure of this kind, compared to a general mist ejection head in which air bubbles are liable to occur at the corners of the bonding sections between the nozzle plate 510 and the reflector, air bubbles do not collect readily about the perimeter of the nozzle 51, and hence air bubble expulsion characteristics are improved and ejection stability is improved.

Though FIGS. 1 to 3 show one liquid chamber unit corresponding to one nozzle 51 (a single mist spraying element), in the case of a mist ejection head for forming images on a recording medium, such as paper, by moving it relatively with respect to the recording medium, a structure comprising a one-dimensional (row-shaped) or two-dimensional (plane-shaped) arrangement of a plurality of liquid chamber units is adopted. In a mist ejection head of this kind, in practice, a plurality of nozzles 51 are formed on the nozzle plate 510, a plurality of liquid chambers 52 are formed in the liquid chamber plate 520, and an ultrasonic wave generating element 58 and a reflector 80 are provided for each of the liquid chambers 52.

Comparison with General Mist Election Head

Figure 12:
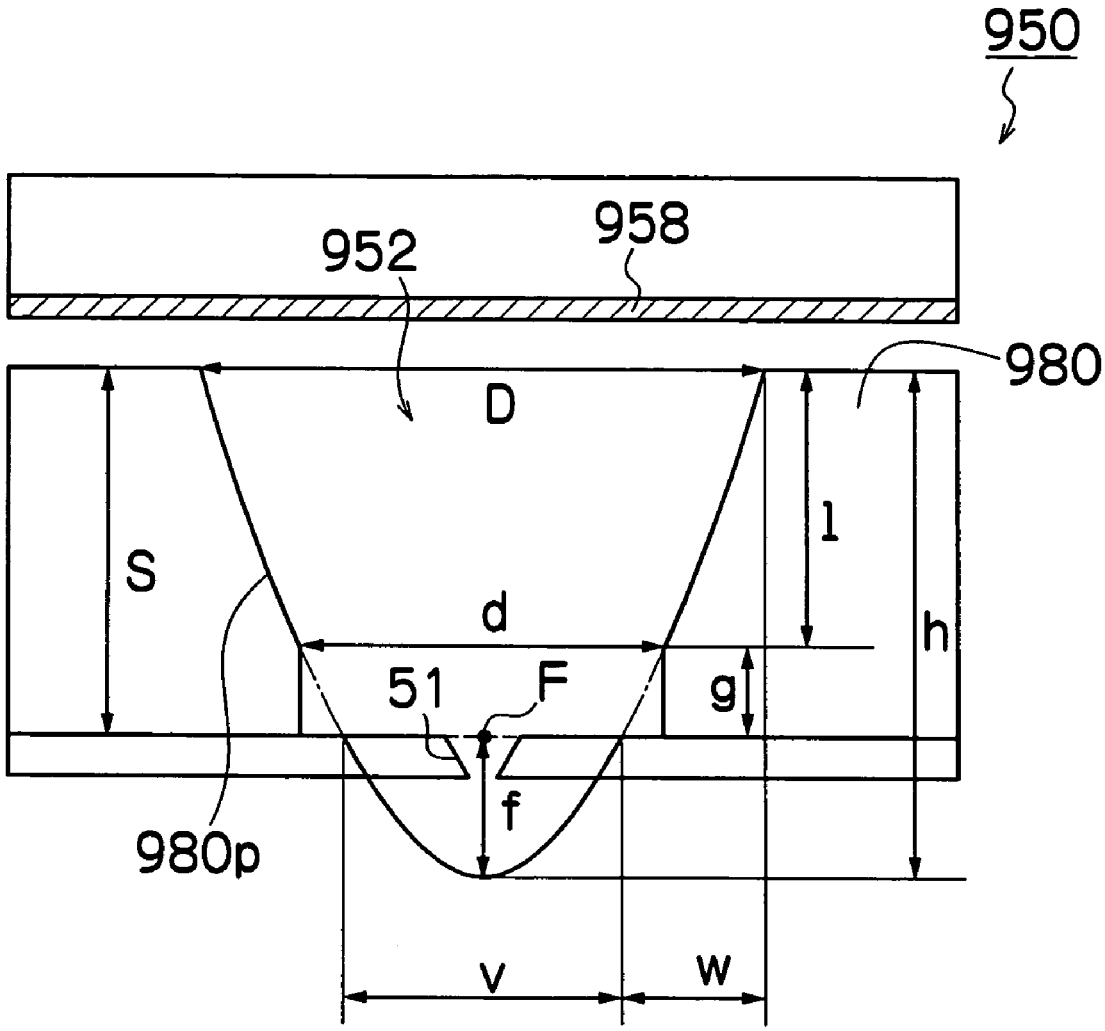
FIG. 12 is an illustrative diagram used for describing the effects of a direct wave on the concentration scale factor of the mist ejection head according to the related art.

FIG. 12 shows an illustrative diagram of a simplified view of a general mist ejection head 950, in order to describe the concentration scale factor of the ultrasonic wave in the general mist ejection head 950.

The values h, f, l, g, s and w in FIG. 12 are represented respectively by the following Formulas 1 to 6.

$$h=aD/2 \quad \text{Formula 1}$$

$$f=D/8a \quad \text{Formula 2}$$

$$l=(a/2D)\times(D^2-d^2) \quad \text{Formula 3}$$

$$g=h-(f+1) \quad \text{Formula 4}$$

$$s=h-f \quad \text{Formula 5}$$

$$w=(D-v)/2 \quad \text{Formula 6}$$

"a" represents the curvature of the parabola. "D" represents the diameter of the opening section where the cross-sectional area of the opening of the paraboloid 980*p* is a maximum. "d" represents the diameter of the portion where the cross-sectional area of the opening of the paraboloid 980*p* is a minimum. The term "v" in FIG. 12 is obtained by resolving Formula 4 for "g=0", and it is expressed by Formula 7.

$$v=D/2a \quad \text{Formula 7}$$

Furthermore, if g is given (g>0), then the surface area S which contributes to the concentration of the ultrasonic wave, and the concentration scale factor of the ultrasonic wave m, are expressed by Formula 8.

$$S=\pi(D^2-d^2)/4$$

$$m=(D^2-d^2)/\lambda^2 \quad \text{Formula 8}$$

Here, "λ" represents the wavelength of the ultrasonic wave.

If g=0 (in other words, d=v), then the surface area S contributing to the concentration of the ultrasonic wave, and the concentration scale factor m of the ultrasonic wave, are expressed by Formula 9 on the basis of Formulas 7 and 8.

$$S=\pi(D^2-v^2)/4=\pi D^2(4a^2-1)/16a^2$$

$$m=(D^2-v^2)/\lambda^2 \quad \text{Formula 9}$$

The concentration scale factor of the ultrasonic wave in the general mist ejection head 950 has been described above.

Figure 4:
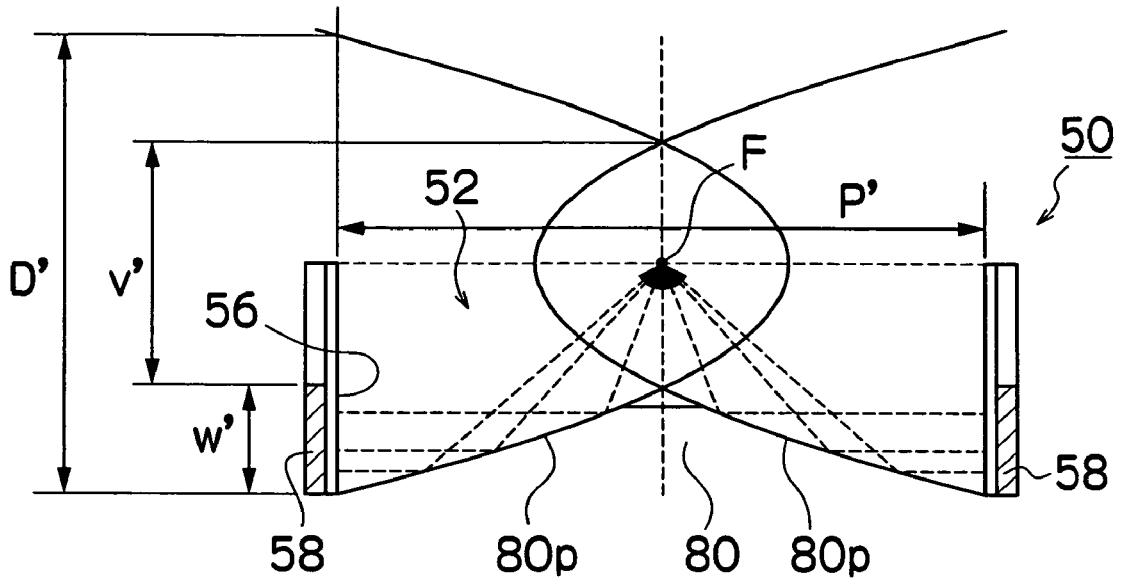
FIG. 4 is an illustrative diagram used for describing the improvement of the energy efficiency of the mist ejection head according to an embodiment of the present invention.

FIG. 4 is an illustrative diagram showing a simplified view of the mist ejection head 50, in order to describe the concentration scale factor of the ultrasonic wave in the mist ejection head 50 according to one embodiment of the present invention.

In the mist ejection head 50 in FIG. 4, the surface area S' of the reflector 80 contributing to concentration of the ultrasonic wave is expressed by Formula 10.

$$S'=\pi P'w' \quad \text{Formula 10}$$

Here, "P'" and "w'" represent the distances indicated in FIG. 4. In other words, P' represents the internal diameter of the cylindrically shaped liquid chamber 52. "w'" is comparable to w in FIG. 12, and in FIG. 4, it is the width obtained when the paraboloid 80*p* is projected to the side wall 56 of the liquid chamber 52, in other words, it is the height of the paraboloid 80*p*.

P' and w' are represented respectively by Formulas 11 and 12.

$$P'=2s' \quad \text{Formula 11}$$

Here, "s'" comparable to s in FIG. 12 represents the distance from the side wall 56 of the liquid chamber 52 until the focal point F in FIG. 4.

$$w'=(D'-v')/2=(D'/2)\times(1-1/2a') \quad \text{Formula 12}$$

Here, "D'" is comparable to D in FIG. 12, and in FIG. 4, it represents the distance in the vertical direction between the intersection points of the parabola where the parabola intersects with a vertical line including the side wall 56 of the liquid chamber 52. "v'" is comparable to v in FIG. 12, and in FIG. 4, it represents the distance in the vertical direction between the intersection points of the parabola where the parabola intersects with a vertical line which passes through the focal point F. "a'" represents the curvature of the parabola.

According to Formulas 10, 11 and 12, in the mist ejection head 50 according to the present embodiment, the surface area S' contributing to the concentrating effect of the reflector 80 is expressed by Formula 13.

$$S'=\pi D'^2(1+2a')(1-2a')^2/16a'^2 \quad \text{Formula 13}$$

The ratio S'/S between the surface areas contributing to concentration of the ultrasonic wave in the mist ejection head 950 based on the related art and the mist ejection head 50 based on the present embodiment, is expressed by Formula 14, when "a=a'" and "D=D'" are satisfied.

$$S'/S=2a-1 \quad \text{Formula 14}$$

More specifically, the concentration scale factor of the ultrasonic wave is (2a−1) times that of the related art.

For example, if "a=1.5" is satisfied in Formula 14, then "S'/S=2" is satisfied. More specifically, the concentration scale factor of the ultrasonic wave is 2 times that of the related art.

Furthermore, if "P'=D" is satisfied, for example, then Formula 15 is established.

$$P'=D=2s' \quad \text{Formula 15}$$

If this Formula 15 is solved with respect to D', then Formula 16 is obtained.

$$D'=4aD/(4a'^2-1) \quad \text{Formula 16}$$

Formula 17 is obtained on the basis of Formulas 16 and 12.

$$S'=\pi Dw'=\pi D^2/(2a'+1) \quad \text{Formula 17}$$

In Formula 17, if "a'=a" is satisfied, Formula 18 is obtained.

$$S'/S=16a^2/(2a-1)(2a'+1)^2 \quad \text{Formula 18}$$

If "a=1.5" is satisfied in Formula 18, then "S'/S=1.125" is satisfied. More specifically, the concentration scale factor of the ultrasonic wave is 1.125 times that of the related art.

General Composition of Image Forming Apparatus

An embodiment of an image recording apparatus using the mist ejection head 50 described above is explained below.

Figure 5:
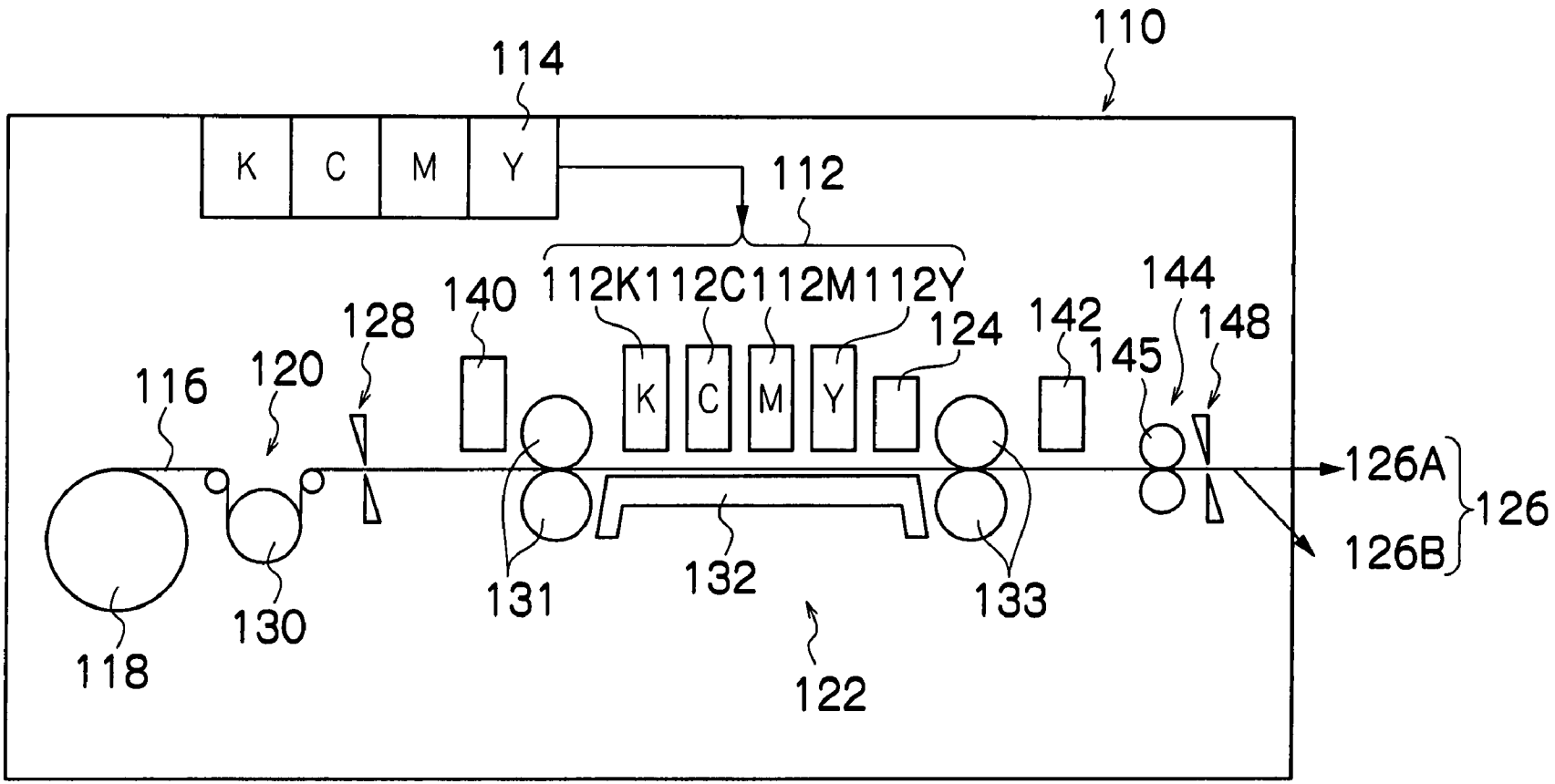
FIG. 5 is an overall compositional diagram showing an embodiment of an image forming apparatus employing the mist ejection head according to an embodiment of the present invention.

FIG. 5 shows a general schematic drawing of an image forming apparatus relating to one embodiment of the present invention. The image forming apparatus 110 shown in FIG. 5 comprises: a print unit 112 having a plurality of mist ejection heads (hereinafter, called "heads") 112K, 112C, 112M, and 112Y provided for ink colors of black (K), cyan (C), magenta (M), and yellow (Y), respectively; an ink storing and loading unit 114 for storing inks to be supplied to the heads 112K, 112C, 112M and 112Y; a paper supply unit 118 for supplying recording paper 116 forming a recording medium; a decurling unit 120 for removing curl in the recording paper 116; a belt conveyance unit 122, disposed facing the nozzle face (ink ejection face) of the print unit 112, for conveying the recording paper 116 while keeping the recording paper 116 flat; a print determination unit 124 for reading the printed result produced by the print unit 112; and a paper output unit 126 for outputting recorded recording paper (printed matter) to the exterior.

The ink storing and loading unit 114 has ink tanks for storing the inks of K, C, M and Y to be supplied to the heads 112K, 112C, 112M, and 112Y, and the tanks are connected to the heads 112K, 112C, 112M, and 112Y by means of prescribed channels.

In FIG. 5, a magazine for rolled paper (continuous paper) is shown as an embodiment of the paper supply unit 118; however, more magazines with paper differences such as paper width and quality may be jointly provided. Moreover, papers may be supplied with cassettes that contain cut papers loaded in layers and that are used jointly or in lieu of the magazine for rolled paper.

The recording paper 116 delivered from the paper supply unit 118 retains curl due to having been loaded in the magazine. In order to remove the curl, heat is applied to the recording paper 116 in the decurling unit 120 by a heating drum 130 in the direction opposite from the curl direction in the magazine.

In the case of the configuration in which roll paper is used, a cutter (first cutter) 128 is provided as shown in FIG. 5, and the continuous paper is cut into a desired size by the cutter 128. When cut papers are used, the cutter 128 is not required.

After decurling, the cut recording paper 116 is nipped and conveyed by the pair of conveyance rollers 131, and is supplied onto the platen 132. A pair of conveyance rollers 133 is also disposed on the downstream side of the platen 132 (the downstream side of the print unit 112), and the recording paper 116 is conveyed at a prescribed speed by the joint action of the front side pair of conveyance rollers 131 and the rear side pair of conveyance rollers 133.

The platen 132 functions as a member which holds (supports) the recording paper 116 while keeping the recording paper 116 flat (a recording medium holding device), as well as being a member which functions as the rear surface electrode. The platen 132 in FIG. 5 has a width dimension which is greater than the width of the recording paper 116, and at least the portion of the platen 132 opposing the nozzle surface of the print unit 112 and the sensor surface of the print determination unit 124 is a horizontal surface (flat surface).

A heating fan 140 is provided in the conveyance path of the recording paper 116, on the upstream side of the print unit 112. This heating fan 140 blows heated air onto the recording paper 116 before printing, and thereby heats up the recording paper 116. Heating the recording paper 116 before printing means that the ink will dry more readily after landing on the paper.

Figure 6:
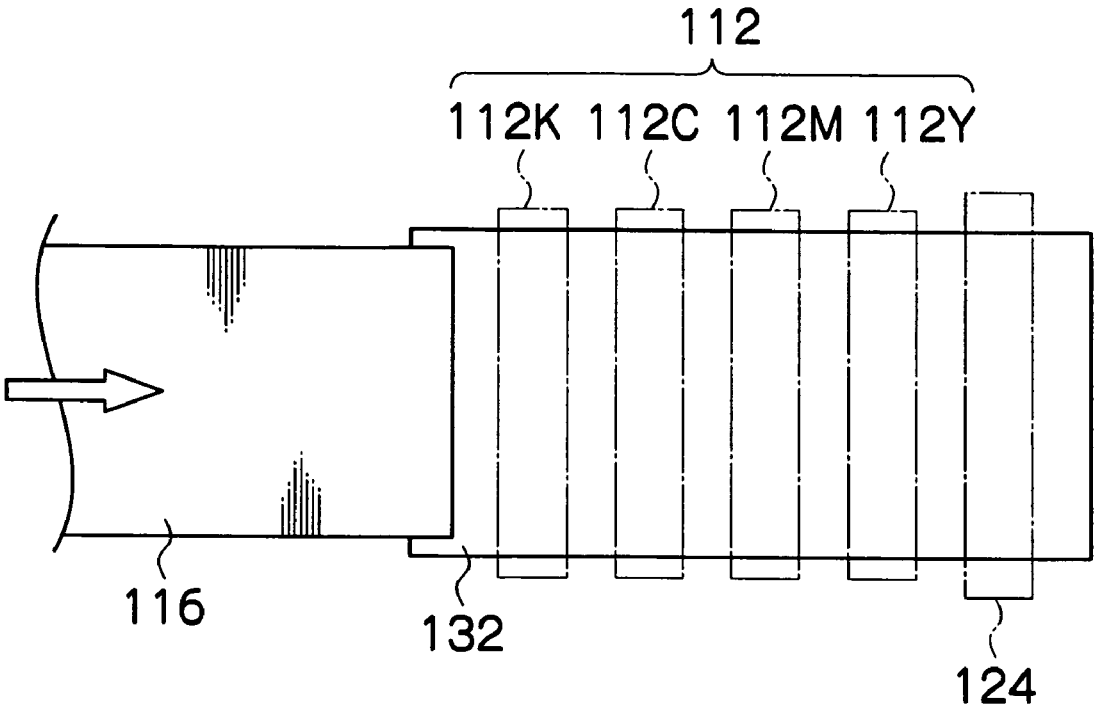
FIG. 6 is a plan view of the principal part of the peripheral area of a print unit in the image forming apparatus illustrated in FIG. 5.

The liquid ejection heads 112K, 112C, 112M and 112Y of the print unit 112 are full line type heads having a length corresponding to the maximum width of the recording paper 116 used with the image forming apparatus 110, and comprising a plurality of nozzles for ejecting ink arranged on a nozzle face through a length exceeding at least one edge of the maximum-size recording paper (namely, the full width of the printable range) (see FIG. 6).

The print heads 112K, 112C, 112M and 112Y are arranged in color order (black (K), cyan (C), magenta (M), yellow (Y)) from the upstream side in the feed direction of the recording paper 116, and these respective heads 112K, 112C, 112M and 112Y are fixed extending in a direction substantially perpendicular to the conveyance direction of the recording paper 116.

A color image can be formed on the recording paper 116 by spraying inks of different colors from the heads 112K, 112C, 112M and 112Y, respectively, onto the recording paper 116 while the recording paper 116 is conveyed by the belt conveyance unit 122.

By adopting a configuration in which the full line heads 112K, 112C, 112M and 112Y having nozzle rows covering the full paper width are provided for the respective colors in this way, it is possible to record an image on the full surface of the recording paper 116 by performing just one operation of relatively moving the recording paper 116 and the print unit 112 in the paper conveyance direction (one sub-scanning operation), in other words, by means of a single sub-scanning action. Higher-speed printing is thereby made possible and productivity can be improved in comparison with a shuttle type head configuration in which a recording head reciprocates in the main scanning direction.

Although the configuration with the KCMY four standard colors is described in the present embodiment, combinations of the ink colors and the number of colors are not limited to those. Light inks, dark inks or special color inks can be added as required. For example, a configuration is possible in which heads for spraying light-colored inks such as light cyan and light magenta are added. Furthermore, there are no particular restrictions of the sequence in which the heads of respective colors are arranged.

The print determination unit 124 illustrated in FIG. 5 has an image sensor (line sensor or area sensor) for capturing an image of the droplet ejection result of the print unit 112, and functions as a device to check for spraying defects such as blockages, landing position displacement, and the like, of the nozzles from the image of ejected droplets read in by the image sensor. A test pattern or the target image printed by the print heads 112K, 112C, 112M, and 112Y of the respective colors is read in by the print determination unit 124, and the print result is determined.

A post-drying unit 142 is disposed following the print determination unit 124. The post-drying unit 142 is a device to dry the printed image surface, and includes a heating fan, for example.

A heating/pressurizing unit 144 is disposed following the post-drying unit 142. The heating/pressurizing unit 144 is a device to control the glossiness of the image surface, and the image surface is pressed with a pressure roller 145 having a predetermined uneven surface shape while the image surface is heated, and the uneven shape is transferred to the image surface.

The printed matter generated in this manner is outputted from the paper output unit 126. The target print (i.e., the result of printing the target image) and the test print are preferably outputted separately. In this image forming apparatus 110, a sorting device (not shown) is provided for switching the outputting pathways in order to sort the printed matter with the target print and the printed matter with the test print, and to send them to paper output units 126A and 126B, respectively. When the target print and the test print are simultaneously formed in parallel on the same large sheet of paper, the test print portion is cut and separated by a cutter (second cutter) 148. Although not shown in FIG. 5, the paper output unit 126A for the target prints is provided with a sorter for collecting prints according to print orders.

Structure of the Head

Next, the structure of a head is described below. The heads 112K, 112C, 112M and 112Y of the respective ink colors have the same structure, and a reference numeral 150 is hereinafter designated to any of the heads.

Figure 7:
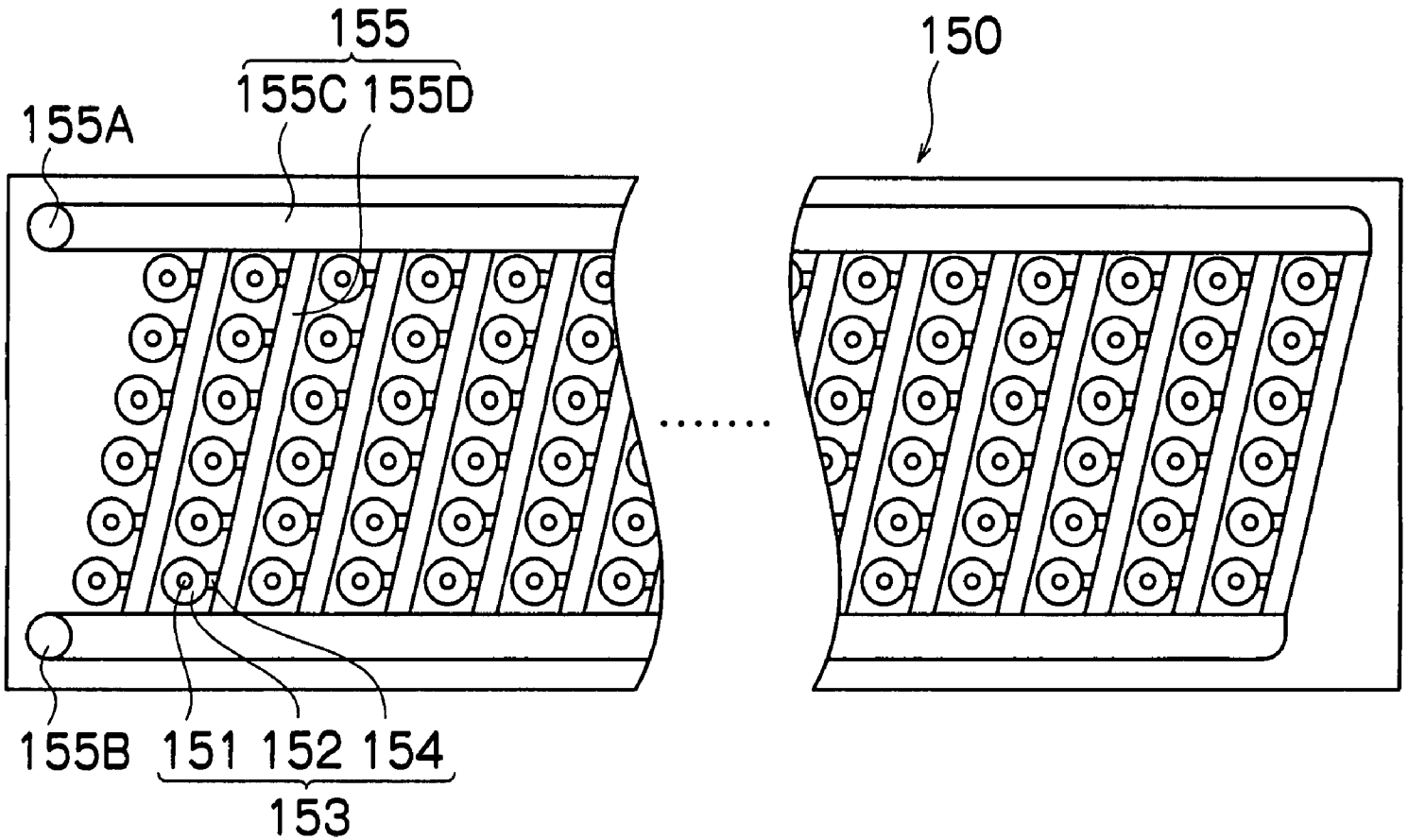
FIG. 7 is a plan view perspective diagram showing the general structure of one embodiment of a mist ejection head.

FIG. 7 is a plan view perspective diagram of the head 150. In order to achieve a high density of the dot pitch formed on the surface of the recording paper 116, it is necessary to achieve a high density of the nozzle pitch in the head 150. As shown in FIG. 7, the head 150 according to the present embodiment has a structure in which a plurality of ink chamber units (mist spraying elements) 153, each including a nozzle 151 forming an ink spraying port, an ink chamber 152 corresponding to the nozzle 151, and the like, are disposed in the form of a two-dimensional matrix, and hence the effective nozzle interval (the projected nozzle pitch) as projected in the lengthwise direction of the head (the direction perpendicular to the paper conveyance direction) is reduced (high nozzle density is achieved). In FIG. 7, in order to simplify the drawing, a portion of the ink chamber units 153 is omitted from the drawing.

The respective ink chambers 152 are connected to a common flow channel 155 via individual supply channels 154. The common flow channel 155 is connected to an ink tank which forms an ink source, via connection ports 155A and 155B (equivalent to the ink storing and loading unit 114 shown in FIG. 5), and the ink supplied from the ink tank is distributed and supplied to the ink chambers 152 of the respective channels via the common flow channel 155 in FIG. 7. The reference numeral 155C in FIG. 7 indicates a main channel of the common flow channel 155 and 155D indicates a tributary channel which branches off from the main channel 155C.

To give a brief description of the composition of the head 150 shown in FIG. 7 and its correspondence to the composition shown in FIGS. 1 to 3, the nozzles 151, ink chambers 152 and individual supply paths 154 in FIG. 7 correspond respectively to the nozzles 51, ink chambers 52 and ink supply ports 53 shown in FIGS. 1 to 3. Furthermore, in FIG. 7, the tributary channels of the common flow channel indicated by the reference numeral 155D correspond to the common flow channel 55 shown in FIG. 1.

The detailed structure of the respective ink chamber units 153 in FIG. 7 is similar to that described in FIGS. 1 to 3.

Figure 8:
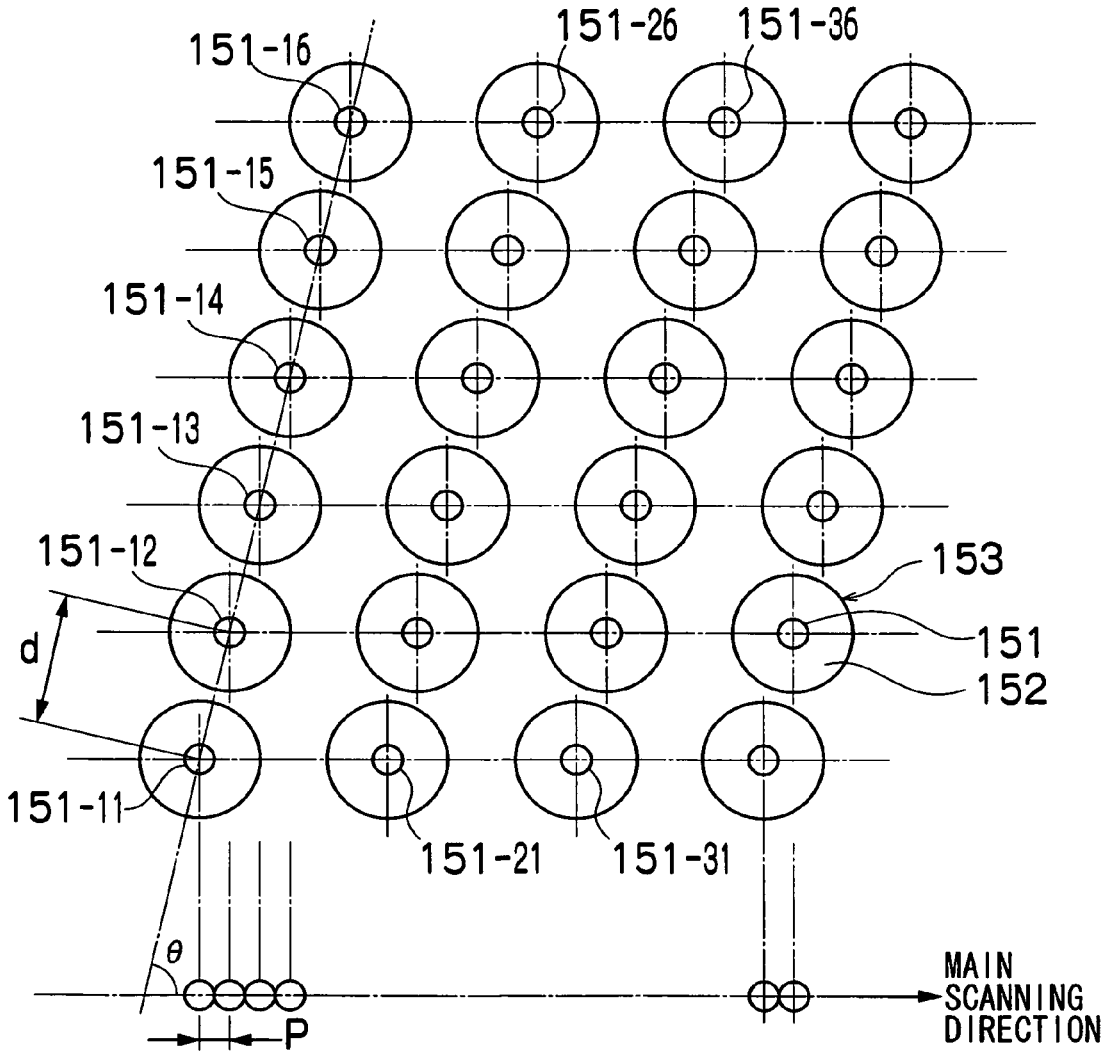
FIG. 8 is an enlarged diagram showing an enlarged view of a portion of FIG. 7.

FIG. 8 is an enlarged view showing an enlarged view of a portion of the print head 150 shown in FIG. 7. As shown in FIG. 8, the plurality of ink chamber units 153 are arranged in a lattice configuration in two directions: the main scanning direction and an oblique direction forming a prescribed angle of θ with respect to the main scanning direction. More specifically, a plurality of nozzles 151 are arranged in a two-dimensional matrix configuration. By arranging the nozzles in a two-dimensional matrix of this kind, a high density is achieved for the effective nozzle density.

More specifically, by arranging a plurality of ink chamber units 153 at a uniform pitch of d in an oblique direction forming a uniform angle of θ with respect to the main scanning direction, it is possible to treat the nozzles 151 as being equivalent to an arrangement of nozzles at a pitch P (=d×cos θ) in a straight line in the main scanning direction. Consequently, it is possible to achieve a composition which is substantially equivalent to a high-density nozzle arrangement of 2400 nozzles per inch (2400 nozzles/inch) in the main scanning direction.

Figure 9:
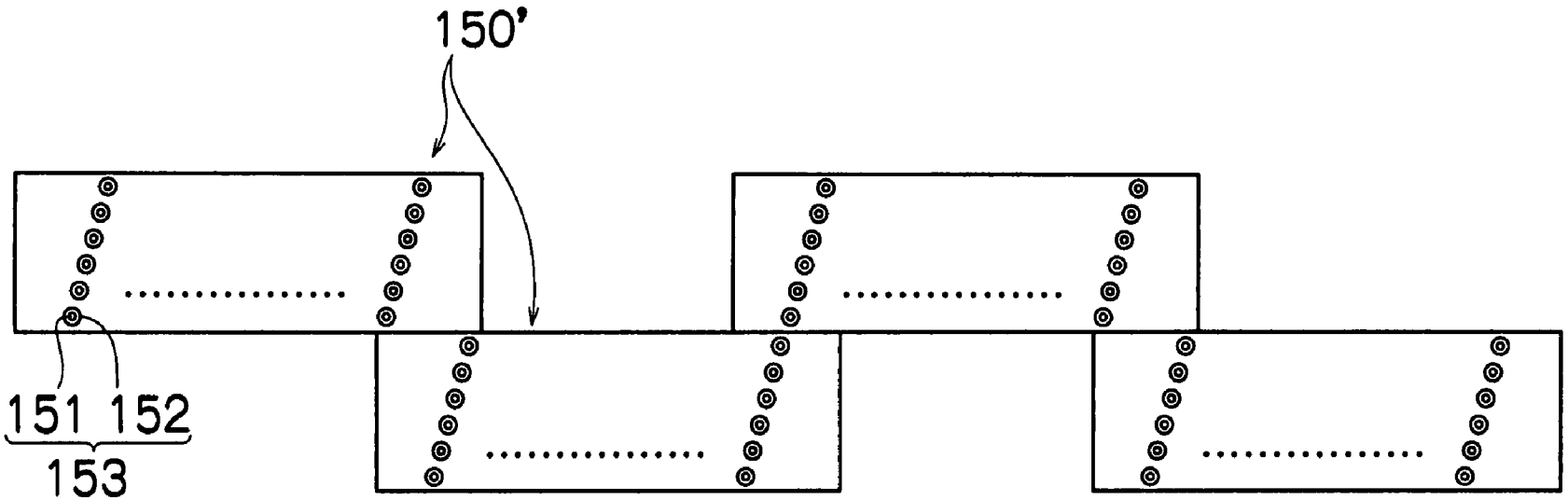
FIG. 9 is a plan view perspective diagram showing the general structure of another embodiment of the mist ejection head.

In implementing the present invention, the nozzle arrangement structure is not limited to the embodiment shown in FIG. 7 and FIG. 8. For example, in one mode of a full line head which has a nozzle row extending through a length corresponding to the full width of the recording paper 116 in a direction substantially perpendicular to the conveyance direction of the recording paper 116, instead of the composition shown in FIG. 7, it is possible to compose a line head having a nozzle row of a length corresponding to the full width of the recording paper 116 by joining together, in a staggered matrix arrangement, a plurality of short head blocks 150', each comprising a plurality of nozzles 151 arranged in a two-dimensional configuration, as shown in FIG. 9, for instance.

Description of Control System

Figure 10:
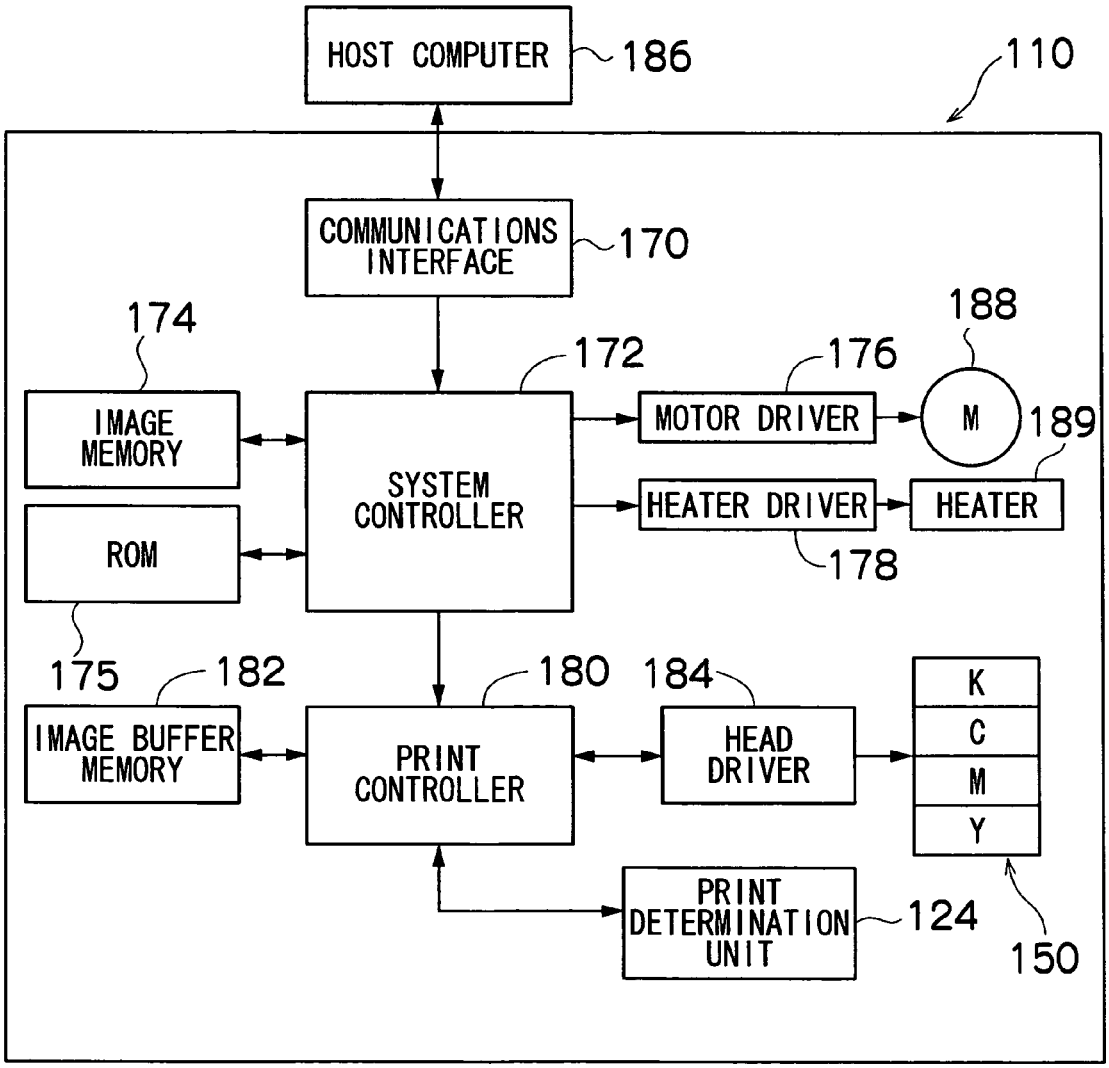
FIG. 10 is a principal block diagram showing the system composition of an image forming apparatus.
Figure 11:
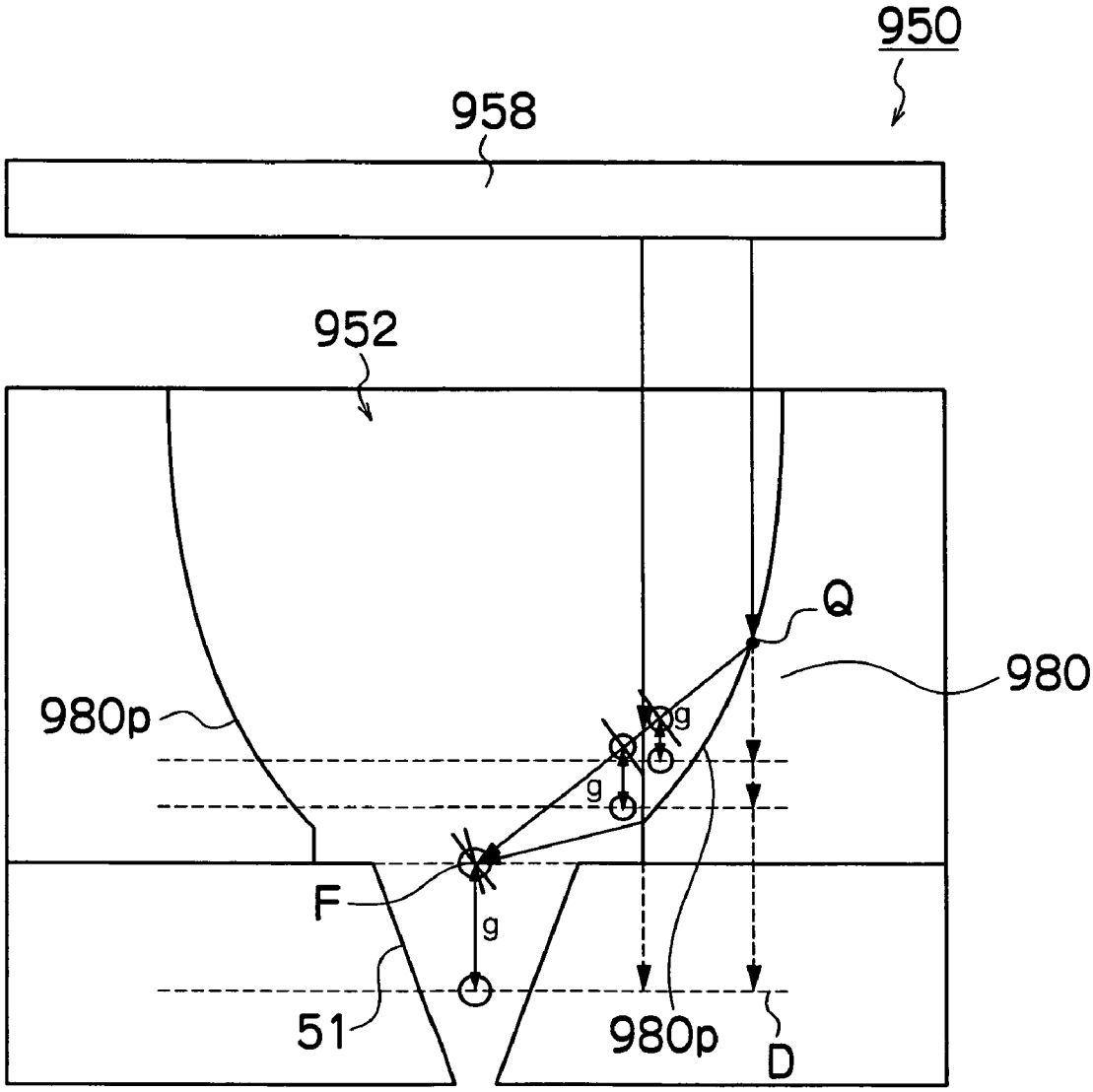
FIG. 11 is a cross-sectional diagram showing the principal part of the mist ejection head according to the related art.

FIG. 10 is a block diagram showing an embodiment of the system composition of the image forming apparatus 110. As shown in FIG. 10, the image forming apparatus 110 comprises a communications interface 170, a system controller 172, an image memory 174, a ROM 175, a motor driver 176, a heater driver 178, a print controller 180, an image buffer memory 182, a head driver 184, and the like.

The communications interface 170 is an image input device for receiving image data transmitted by a host computer 186. For the communications interface 170, a wired or wireless interface, such as a USB (Universal Serial Bus), IEEE 1394, wireless network, or the like, can be used.

Image data sent from a host computer 186 is read into the image forming apparatus 110 via the communications interface 170, and is stored temporarily in the image memory 174.

The system controller 172 is constituted by a central processing unit (CPU) and peripheral circuits thereof, and the like, which controls the whole of the image forming apparatus 110 in accordance with a prescribed program. More specifically, the system controller 172 controls the various sections, such as the communications interface 170, image memory 174, motor driver 176, heater driver 178, and the like; controls communications with the host computer 186 and writing and reading to and from the image memory 174 and ROM 175; and also generates control signals for controlling the motor 188 and heater 189 of the conveyance system. The motor 188 of the conveyance system is a motor which applies a drive force to the drive rollers of the pairs of conveyance rollers 131 and 133 shown in FIG. 5, for example. Furthermore, the heater 189 is a heating device which is used in the heating drum 130, heating fan 140 or post drying unit 142, as shown in FIG. 5.

The program executed by the CPU of the system controller 172 and the various types of data which are required for control procedures are stored in the ROM 175. The ROM 175 may be a non-rewriteable storage device, or it may be a rewriteable storage device, such as an EEPROM. The image memory 174 is used as a temporary storage region for the image data, and it is also used as a program development region and a calculation work region for the CPU.

The motor driver 176 is a driver (drive circuit) which drives the motor 188 of the conveyance system in accordance with instructions from the system controller 172. The heater driver 178 is a driver which drives the heater 189 in accordance with instructions from the system controller 172.

The print controller 180 functions as a signal processing device which generates dot data for the inks of respective colors on the basis of the input image. More specifically, the print controller 180 is a control unit which performs various treatment processes, corrections, and the like, in accordance with the control implemented by the system controller 172, in order to generate a signal for controlling ink spraying, from the image data in the image memory 174, and it supplies the data (dot data) thus generated to the head driver 184.

The image buffer memory 182 is provided in the print controller 180, and image data, parameters, and other data are temporarily stored in the image buffer memory 182 when the image is processed in the print controller 180. FIG. 10 shows a mode in which the image buffer memory 182 is attached to the print controller 180; however, the image memory 174 may also serve as the image buffer memory 182. Also possible is a mode in which the print controller 180 and the system controller 172 are integrated to form a single processor.

To give a general description of the sequence of processing from image input to image formation, image data to be formed is input from an external source via a communications interface 170, and is accumulated in the image memory 174. At this stage, RGB image data is stored in the image memory 174, for example.

In this image forming apparatus 110, an image which appears to have a continuous tonal graduation to the human eye is formed by changing the droplet ejection density and the dot size of fine dots created by ink (coloring material), and therefore, it is necessary to convert the input digital image into a dot pattern which reproduces the tonal graduations of the image (namely, the light and shade toning of the image) as faithfully as possible. Therefore, original image data (RGB data) stored in the image memory 174 is sent to the print controller 180 through the system controller 172, and is converted to the dot data for each ink color by a half-toning technique, using dithering, error diffusion, or the like, in the print controller 180.

In other words, the print controller 180 performs processing for converting the input RGB image data into dot data for the four colors of K, C, M and Y. The dot data generated by the print controller 180 in this way is stored in the image buffer memory 182.

The head driver 184 outputs drive signals for driving the electromagnets 56 corresponding to the respective nozzles 151 of the print head 150, on the basis of the dot data supplied by the print controller 180 (in other words, the dot data stored in the image buffer memory 182). In other words, the head driver 184 corresponds to the "drive unit" of the present invention. A feedback control system for maintain uniform driving conditions in the head may also be incorporated into the head driver 184.

By supplying the drive signals output by the head driver 184 to the head 150, an ink mist is sprayed from the corresponding nozzles 151. By controlling ink spraying from the head 150 in synchronization with the conveyance speed of the recording paper 116, an image is formed on the recording paper 116.

Furthermore, the shape of the reflector 80 is not limited to that shown in the drawings, and the shape may also be modified, appropriately.

The present invention is not limited to the examples described in the above embodiments, and various design modifications and improvements may be implemented without departing from the scope of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A mist ejection head comprising:

a nozzle ejecting a liquid in a form of a mist;

a liquid chamber connected to the nozzle;

an ultrasonic wave generating element which is disposed on a side wall of the liquid chamber and which generates an ultrasonic wave in such a manner that the ultrasonic wave is applied to the liquid inside the liquid chamber; and a reflector having a reflecting surface which reflects the ultrasonic wave generated by the ultrasonic wave generating element in such a manner that the ultrasonic wave is directed toward a center of the liquid chamber and concentrated at a focal point situated in a vicinity of the nozzle inside the liquid chamber, wherein the liquid chamber has a cylindrical shape having an axis passing through the focal point, and the reflector has a protrusion shape having the reflecting surface formed by rotating, around the axis of the liquid chamber, a parabola having a central axis which is perpendicular to the axis of the liquid chamber.

2. The mist ejection head as defined in claim 1, wherein a cross-sectional shape of the reflecting surface of the reflector includes two parabolas whose confocal point is located at the same position as the focal point.

3. An image forming apparatus comprising the mist ejection head as defined in claim 1, wherein the liquid is ejected from the nozzle in the form of the mist in such a manner that an image is formed by the liquid on a recording medium.

* * * * *